United States Patent [19]

Dewey

[11] 4,236,555

[45] Dec. 2, 1980

[54] STAND-UP SCREWGUN

[75] Inventor: George G. Dewey, Prospect Heights, Ill.

[73] Assignee: Illinois Tool Works Inc., Chicago, Ill.

[21] Appl. No.: 59,867

[22] Filed: Jul. 23, 1979

[51] Int. Cl.[3] ..... B27B 7/00

[52] U.S. Cl......221/179; 81/431; 81/452; 81/451

[58] Field of Search ..... 145/50; 81/57.37, 57.23, 81/52.4; 227/118, 138; 173/107; 221/179; 144/32

[56] References Cited

U.S. PATENT DOCUMENTS

| | | | |
|---|---|---|---|
| 2,840,126 | 6/1958 | Schmitt | 144/32 |
| 3,528,466 | 9/1970 | Tracy | 144/32 |
| 3,556,184 | 1/1971 | Wagner | 145/50 |
| 3,587,683 | 6/1971 | Bangerter | 144/32 |
| 3,869,942 | 3/1975 | DeCaro | 144/32 |
| 3,960,190 | 6/1976 | Murray | 144/32 R |
| 3,973,605 | 8/1976 | DeCaro | 144/32 R |
| 4,197,886 | 4/1980 | MacDonald | 144/32 R |

*Primary Examiner*—W. Donald Bray

*Attorney, Agent, or Firm*—Thomas Buckman; Richard K. Thomson

[57] ABSTRACT

An attachment for a screwgun is provided which has the capability of handling screw lengths of up to eight inches. The nosepiece is made collapsible to bring the head of the fastener into engagement with the driver. The nosepiece is made removable to facilitate replacement with a shorter nosepiece for feeding smaller fasteners, easy clearing of jams and replacement of the driver bit. The slide collar which moves with the drive rod may be locked in the collapsed position so that the driver bit may be changed without disassembling the attachment or removing it from the power tool.

8 Claims, 6 Drawing Figures

STAND-UP SCREWGUN

Attachments for power screwdrivers have been devised to permit insertion of threaded fasteners from a standing position. These stand-up screwguns, as they are called, represent a substantial time and energy saver for the workman. One such prior art tool is shown in commonly owned U.S. Pat. No. 3,960,191. While usage of this tool, and other attachments like it, is advantageous for shorter screw lengths, as the length of the fastener exceeds four inches, the length of the tool reaches, and can exceed, four feet. At this length, the stand-up screwgun become cumbersome and unwieldy with the handle of the tool approaching shoulder height.

It is an object of the present invention to provide an attachment for a power screwdriver which can accommodate screws in excess of four inches in length while maintaining a useful, practical length.

It is a further object of the invention to provide such an attachment with a readily removable nosepiece to provide for easy clearing of jams, changing of driving bits and changing of nosepieces.

It is a further object of the invention to provide an attachment which has a means to lock the tool in collapsed position with the drive bit projecting to facilitate its removal and replacement.

It is yet another object of the present invention to provide adequate guiding for the drive rod so as to prevent any instability which might otherwise occur due to the tool length.

These and other objects of the invention are achieved by a stand-up screwgun attachment which is double collapsing. That is, both the nosepiece and the slide collar at the upper end are provided with the capability of telescoping movement with respect to the body portion of the attachment. In this manner, the amount of tool length needed to accommodate additional screw length is substantially reduced.

The attachment is provided with a quick disconnect nosepiece. This permits the replacement of the long nosepiece with a much shorter one for the shorter fasteners which, in turn, permits the workman to avoid moving the driver through that unnecessary extra stroke length.

The attachment is also provided with a removable driver bit and a locking position in which the bit extends from the end of the body of the attachment. Both the driver bit and drive rod have flats thereon to facilitate removal of the bit. Accordingly, replacement bits and bits having different configurations can be assembled in the tool without the need for completely disassembling the attachment.

These and other features, objects and advantages of the invention will be better understood by reference to the detailed description taken in conjunction with the accompanying drawings.

DETAILED DESCRIPTION OF THE INVENTION

Figures 1A, 1B:
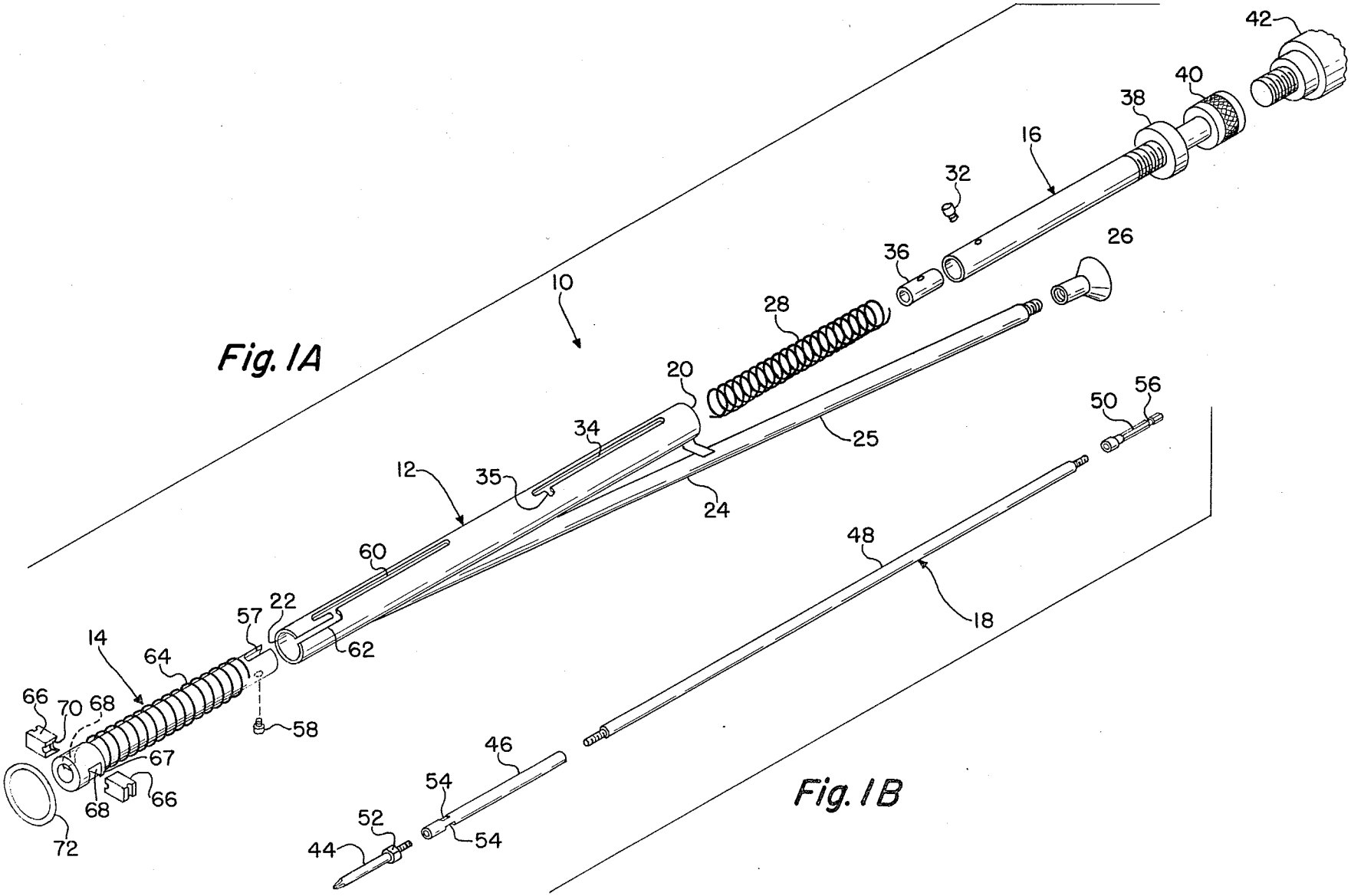
FIG. 1A is an exploded perspective view showing the various elements of the screwgun of the present invention (the nosepiece is shown turned 180° from its assembled position in order to show certain details thereof)
FIG. 1B is an exploded perspective of the drive rod which fits within the screwgun shown in FIG. 1A.
Figure 2A:
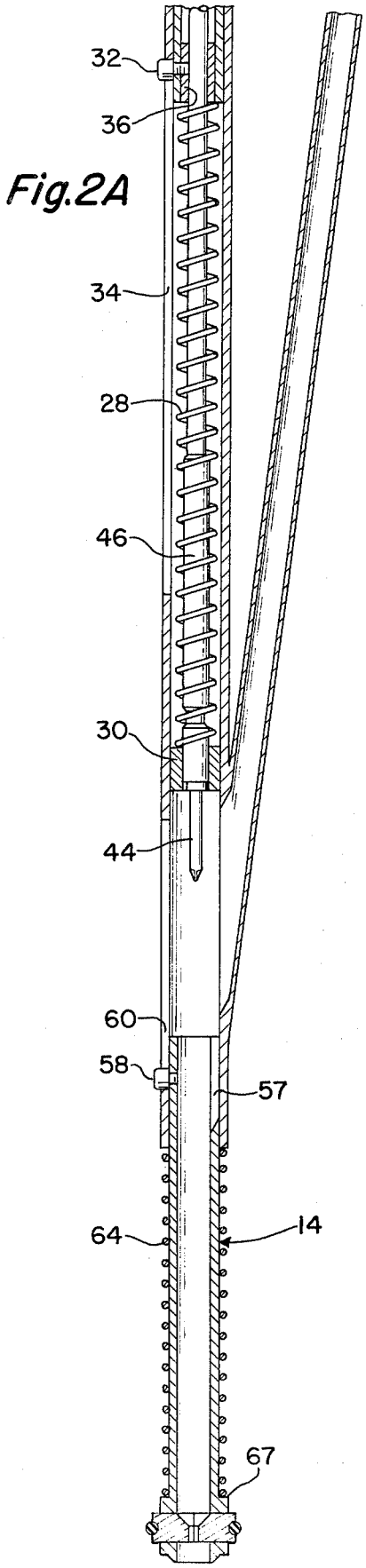
FIG. 2A shows a cross-sectional side view of the assembled tool in its fully extended position.
Figure 2B:
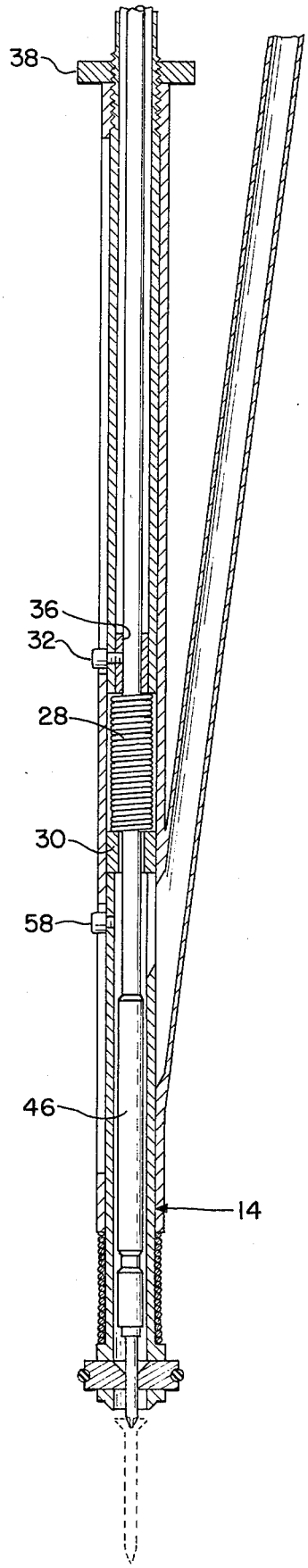
FIG. 2B shows a cross-sectional side view of the assembled tool in its fully collapsed position.

The stand-up screwgun attachment of the present invention is shown generally at 10. The attachment is adapted to be connected to a rotary power tool such as a power screwdriver (not shown) and consists of basically four major components: a main body portion 12, a removable nosepiece 14, a slide collar 16 and a drive rod 18. The body portion 12 has a generally tubular configuration with an upper end 20 and a lower end 22. An angulated feed tube 24, which may have a slight bend at 25 thereof, delivers fasteners to the lower end 22 of the body portion 12. The bend in the feed tube is provided so that the in-feed funnel 26 is conveniently located adjacent slide collar 16 but the bend at 25 must be gradual so that the longer length fasteners will not hangup in the feed tube 24.

Slide collar 16 is also formed as a hollow tube having an outside diameter such that it may be telescopically received in the upper end 20 of body portion 12. The primary function of slide collar 16 is to move with drive rod 18 and control its movement with respect to main body portion 12. A biasing spring 28 has generally the same diameter as the slide collar and fits into the body portion ahead thereof. A tubular bearing member 30 stationarily positioned within the tube of the body portion 12 limits the downward movement of spring 28. The spring 28 reacts against bearing 30 at one end and against the end of slide collar 16 at its other end to bias the collar out of the body portion to its extended position. A setscrew 32 engages in slot 34 to retain the slide collar 16 in assembled condition with body portion 12. The slot 34 is interconnected with a circumferentially extending locking slot 35 whose function will be discussed in greater detail herebelow.

A second bearing member 36 which may, for example, be made of brass, is positioned within the slide tube 16 and retained there by setscrew 32. The bearing member has two functions: it guides the upper portion 48 of drive rod 18 and it prevents spring 28 from slipping inside slide collar 16. As is known, the slide collar is provided with a depth setting adjustment 38 which is retained in axially adjusted positon along a threaded portion of the collar 16 by detent mechanisms (not shown). This collar limits the amount of telescopic movement of the slide collar into the body member 12 and in turn, as will be seen, limits the axial distance drive rod 18 moves, thus setting the depth to which the fastener is driven. A threaded attachment collar 40 is universally mounted on the upper end of collar 16 to facilitate attachment to a rotary power tool or to an adaptor 42, as the configuration of the tool may require.

Drive rod 18 is subdivided into four segments: a fastener engaging driver bit 44, a bearing surface portion 46 which has an enlarged diameter, an upper portion 48 and a drive-receiving portion 50. Driver bit 44 is shown as having a cruciform configuration for reception in a correspondingly shaped recess in the fastener head. Of course, other bit configurations, including external drives are possible and, in fact, it is for this reason (in additon to wear considerations) that the driver bit 44 is made easily replaceable. To this end, bit 44 has one or more flats 52 thereon to permit it to be engaged by a tool and unthreaded from bearing surface member 46. Similarly, member 46 has a pair of flats 54 to permit it to be engaged by a tool to restrain the bearing surface member against rotational movement during the bit changing procedure. The outside diameter of bearing surface member 46 is larger than the remaining portion of the drive rod and is received within tubular bearing member 30. Drive-receiving portion 50 has generally a hexagonal configuration with a retention groove 56 for reception and retention in the drive recess of the power tool. Different power tools may require drive-receiving portions of varying sizes or shapes and, hence, the need to make this portion removable. Accordingly, drive-receiving portion 50 is threadedly secured to the upper portion 48 of drive rod 18.

Nosepiece 14 is removably retained for telescopic movement within the lower end 22 of the main body portion 12. The retention mechanism comprises a setscrew 58 which is received in a slot 60 in the main body portion. The slot 60 is interconnected to a second slot 62 which is open ended. A biasing spring 64 acts between the lower end 22 of the body 12 and an outwardly extending flange 67 to bias the nosepiece 14 to its extended position. By slightly collapsing the spring 64 and rotating setscrew 58 into slot 62, the nosepiece 14 may be easily and quickly removed.

While this screwgun attachment has been designed to handle longer length fasteners (in the range of four to eight inches), it is capable of feeding shorter lengths as well. It will be appreciated that the nosepiece 14 must collapse within the body 12 against the bias of spring 64 in order for bit 44 to contact and drive the fastener. It will further be appreciated that the shorter length fasteners will occupy only the lower extremity of nosepiece 14 and much of the stroke length of the driver rod will be wasted motion. The removability of the nosepiece 14 permits a shorter nosepiece to be connected to body portion 12 to shorten the stroke length. Removability further permits jams to be quickly and easily cleared by providing access to both the nosepiece and the lower end 22 of the body where the feed tube delivers the fasteners.

The nosepiece 14 has a groove 57 in the top edge which is maintained in alignment with feed tube 24 by setscrew 58 and slot 60. In this manner, the nosepiece 14 will not interfere with the feeding of the fasteners. The inner diameter of the nosepiece 14 is slightly larger than the diameter of the fastener head. Due to this configuration, the fastener is maintained concentric with the attachment and is adequately guided during driving. The nosepiece diameter is also slightly larger than the diameter of the bearing surface portion 46. Portion 46 has a length which is greater than the distance between the lower end of bearing 30 and the extended position of the upper edge of the nosepiece. In this manner, as the upper biasing spring collapses and bearing surface portion 46 exits tubular bearing member 30, the leading end portion 46 will be entering nosepiece 14 insuring proper guidance of the drive rod through the entire length of its stroke.

As is known, the nosepiece may be provided with a pair of gripper jaws 66 which has an indentation 70 in the upper surface corresponding generally to the shape of the fastener head. The jaws 66 are biased together through apertures 68 in the end of nosepiece 14 by O-ring 72. Jaws 66 prevent the fastener from falling out of the attachment before insertion of the fastener is completed and also align the fastener for driving. As the head of the fastener is driven downwardly through the region of the jaws 66, those jaws move outwardly against the bias of the O-ring 72 permitting the screw head to pass.

The manner of operation of the device should be understood from the foregoing description. The stand-up screwgun attachment 10 is non-rotatably secured to a rotary power tool, such as a power screwdriver, by means of threaded attachment collar 40 and, if necessary, the internally and externally threaded adaptor 42. Drive-receiving portion 56 is received in the chuck of the power tool and will be rotationally driven thereby. The assembled tool is placed in position and a single fastener inserted through funnel 26 into feed tube 24 and passes into nosepiece 14. End pressure is exerted on the power tool causing springs 28 and 64 to collapse and the fastener head and driver bit 44 to approach one another. Bearing surface portion 46 is guided first by tubular bearing 30, and then by the inside diameter of nosepiece 14. Rotational motion is imparted by the tool to the drive rod and, hence, to the fastener. The nosepiece can be removed to replace it for driving shorter fasteners or for clearing jams. It is also removed in order to replace driver bit 44. Then, the slide collar 16 is collapsed into body member 12 and retained in collapsed position by rotating setscrew 32 into locking slot 35. The bit 44 and bearing surface portion 46 will project from the lower end 22 of the main body 12 and may then be engaged by their respective flats 52 and 54 and the replacement of the bit effected. It should be noted that the slot 60 is longer at its upper end than is necessary to provide for the full stroke of setscrew 58. In this manner, the force of fully collapsing the nosepiece 14 into the main body 12 is born by the upper end of the nosepiece striking slide bearing 30 and not by the setscrew 58.

Figure 3A:
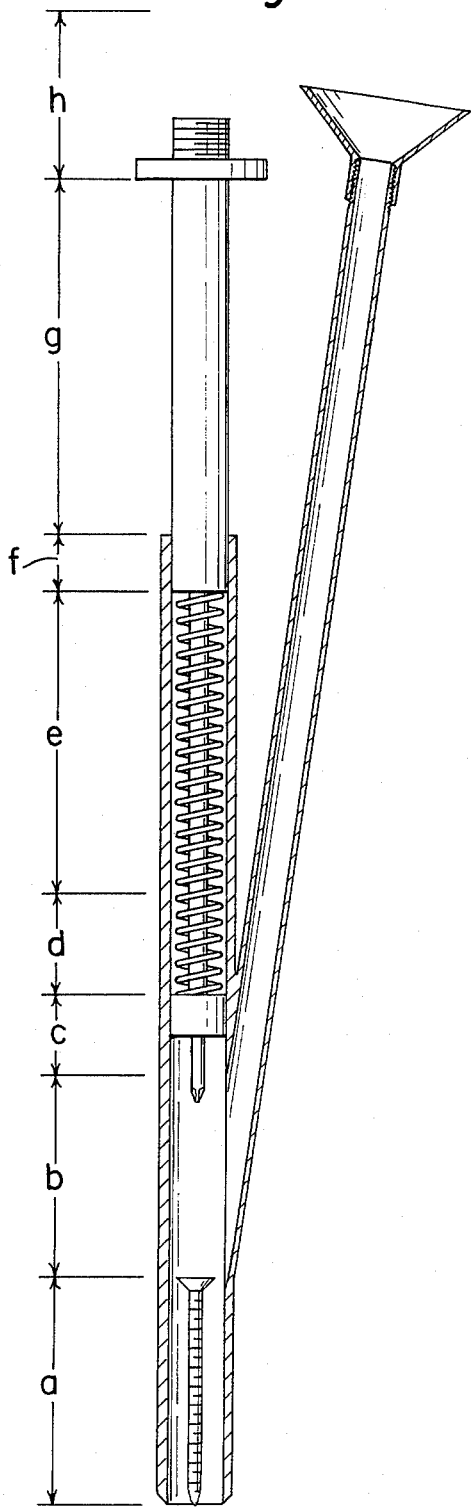
FIG. 3A shows a schematic side elevation of a fixed nosepiece design.
Figure 3B:
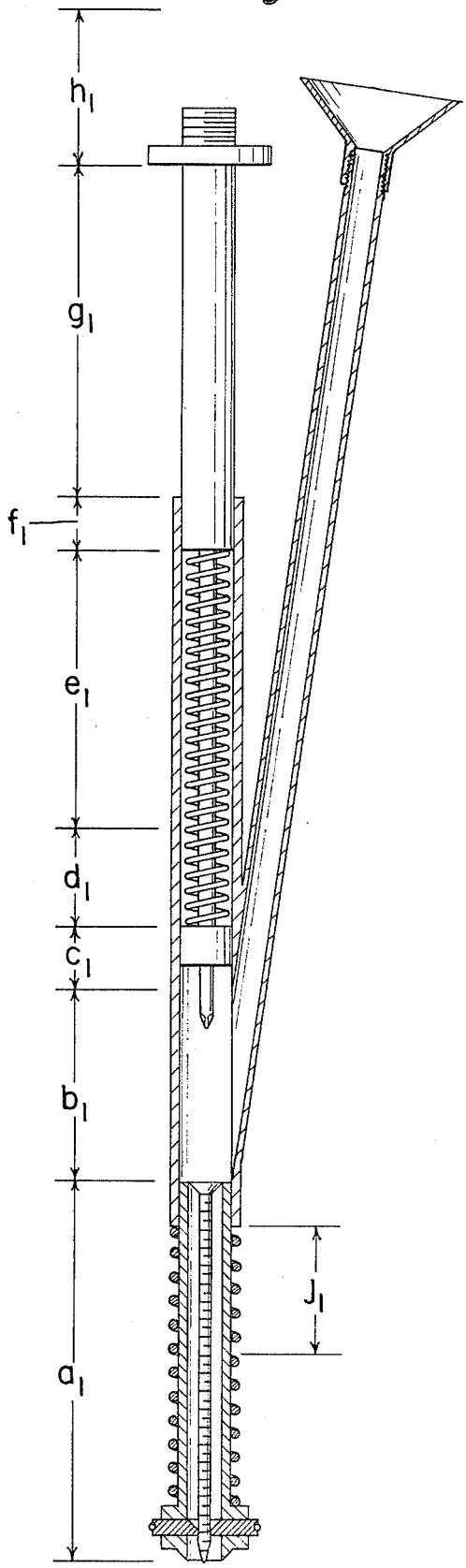
FIG. 3B shows a schematic side elevation of the collapsing nosepiece design of the present invention.

In order to show how much tool length is saved by the double collapsibility of the design, attention is directed to the schematic drawings of FIGS. 3A and 3B. The tool shown in FIG. 3A is a fixed nosepiece design while that shown if FIG. 3B incorporates the features of the present invention. For the fixed nosepiece attachment, the nosepiece must have a length 'a' equal to the length of the longest screw to be driven. The length 'b' represents the feed length or length of the feed tube opening needed for proper feeding of the fastener. This length corresponds generally to two-thirds of the length of the fastener. The lengths 'c', 'f' and 'h' correspond to the lengths of bearing member 30, amount of overlap between the main body 12 and slide collar 16 and the length of the power tool and attachment means, respectively. Since these parameters 'c', 'f' and 'h' are constant for all feed lengths and the purpose here is to indicate the amount of tool length change necessary to accommodate each one inch change in length of the fastener, these constants will be ignored for purposes of this discussion.

It will be understood that the minimum distance the drive bit must move in order to fully seat the fastener is equal to 'a'+'b' or, the length of the fastener plus the length of the feed opening. Accordingly, 'e' and 'g' are both equal to 'a'+'b'. The length 'd' corresponds to the solid or collapsed length of the spring. While this length may vary from $\frac{1}{4}$ to $\frac{1}{2}$ of the extended length of the spring, depending on the spring, an appropriate value is $\frac{1}{3}$. Accordingly, 'd' is equal to $\frac{1}{3}$('a'+'b'). Summing these values shows that the variable length of the tool is equal to 5 5/9 'a'. That is to say, for each inch added to screw length capability, over $5\frac{1}{2}$ inches must be added to the tool.

For the tool of the present invention, a new parameter '$j_1$' is introduced corresponding to the collapsed length of spring 64. It will be appreciated that although '$j_1$' will vary at the rate of $\frac{1}{3}$ of the change in screw length, it will not affect the overall tool length. This is a result of the fact that as the length of the screw '$a_1$' increases, both '$j_1$' and '$b_1$' will also increase always adding up to '$a_1$'. That is to say, regardless of the nosepiece length or the length of its biasing spring, the nosepiece will collapse to bring the screw head into engagement with the driver bit ($j_1+b_1=\frac{1}{3}a_1+\frac{2}{3}a_1$). The drive rod and effective slide collar lengths '$e_1$' '$g_1$' need only be equal to the screw length '$a_1$', and '$d_1$' equals $\frac{1}{3}$'$a_1$'. The overall variable length for the tool of the present invention is therefore 4 '$a_1$', which means the tool length must increase four inches in length for every one inch increase in screw length capability. Therefore, the attachment without the double collapsibility must be nearly 39% longer in length than that of the present design. More important than making a difference in shear numbers, this difference in length is the difference between having a practical, useful tool for permitting insertion of long fasteners from a standing position and having to do it by hand. For an eight inch fastener, the tool length for the two designs shown would be 5 5/9×8″+12″ (the total value of the constant lengths) or $56\frac{1}{4}$″, nearly five feet, as compared with 4×8″+12″ or 44″ long which approaches the maximum length of a practical tool.

While a particular embodiment has been described in conjunction with disclosing the invention, it will be appreciated by the artisan that various changes, modifications and variations could be made. Accordingly, it is intended that such changes, modifications and variations as come within the scope of the appended claims, be encompassed by the invention.

I claim:

1. An attachment for a rotary power tool which permits the installation of threaded fasteners from a standing position said attachment comprising a longitudinal body portion consisting of an open tubular section which has a tubular bearing member situated between an upper and a lower end; a converging feed tube for delivering fasteners successively to the lower end of said body portion; an extendable and retractable drive rod having a fastener-engaging driver portion, an enlarged bearing surface portion with a predetermined outer diameter, and a rotational drive receiving portion; a drive rod slide collar which surrounds a portion of the drive rod and is retained for extendable and retractable telescopic sliding movement therewith within the upper end of the body portion; means for biasing the slide collar to its extended position; an axially extendable and retractable collapsible nosepiece having means to removably retain it in telescopic sliding engagement with the lower end of the body portion and an inner diameter slightly larger than the predetermined diameter of the bearing surface; means for biasing the collapsible nosepiece to its extended position; means for assembling the attachment with a power tool; whereby as axial pressure is applied to the power tool, the biasing means for both the slide collar and nosepiece are overcome and the fastener-engaging driver portion engages a drive means on the head of the fastener to rotationally drive it into a workpiece.

2. The attachment of claim 1 wherein the spacing between the tubular bearing member in the body portion and the uppermost end of the nosepiece in its extended position is less than the length of said bearing surface portion such that the leading end of the bearing surface portion of the drive rod will enter the nosepiece before the trailing end of said bearing surface portion escapes the tubular bearing member.

3. The attachment of claim 1 wherein the means to removably retain the nosepiece comprises a setscrew engaged in said nosepiece which slidably rides in a groove in said body portion, said groove being interconnected with a second open-ended groove which permits removal of said nosepiece.

4. The attachment of claim 1 wherein the fastener-engaging driver portion is threadingly engaged in the remainder of the drive rod, each portion having flats thereon thereby permitting easy replacement of said driver portion.

5. The attachment of claim 4 wherein the upper end of the body portion has a circumferentially extending locking slot to lock the drive rod and slide collar in one of its extended and collapsed positions, respectively, to facilitate said replacement of the driver portion.

6. The attachment of claim 1 wherein the slide collar biasing means comprises a coil spring reacting between the upper surface of said tubular bearing member and the lower surface of said slide collar.

7. The attachment of claim 1 wherein the nosepiece biasing means comprises a coil spring reacting between the lower end of said body portion and a radially outwardly extending flange on said nosepiece.

8. The attachment of claim 1 wherein the nosepiece has a slot in the upper end thereof corresponding in width to the size of the feed tube, so that in its assembled extended position, the nosepiece will not interfere with the ingress of the threaded fastener.

* * * * *